US005938496A

United States Patent [19]

Zheng

[11] Patent Number: 5,938,496

[45] **Date of Patent: *Aug. 17, 1999**

[54] CONSTRUCTIONAL PIECES WITH DEFORMABLE JOINTS

[75] Inventor: Yu Zheng, Covina, Calif.

[73] Assignee: Patent Category Corp., Monrovia, Calif.

[ * ] Notice: This patent is subject to a terminal disclaimer.

[21] Appl. No.: 08/756,256

[22] Filed: Nov. 25, 1996

Related U.S. Application Data

[63] Continuation-in-part of application No. 08/632,678, Apr. 16, 1996.

[51] Int. Cl.[6] ..... A63H 33/08

[52] U.S. Cl. ..... 446/106; 446/107; 446/115; 446/116; 446/121; 403/345

[58] Field of Search ..... 446/85, 106, 107, 446/108, 109, 113–116, 120, 121, 127; 403/345

[56] References Cited

U.S. PATENT DOCUMENTS

| | | | |
|---|---|---|---|
| D. 236,221 | 8/1975 | McAllister et al. . | |
| D. 252,951 | 9/1979 | Schuring . | |
| 1,562,006 | 2/1925 | Sichterman . | |
| 1,882,607 | 3/1932 | Howard . | |
| 2,104,742 | 1/1938 | Fleischer | 446/106 |
| 2,278,327 | 3/1942 | Magnus et al. | 446/124 |
| 2,712,200 | 9/1955 | Dearling | 446/106 |
| 2,844,910 | 7/1958 | Korchak | 446/85 |
| 3,199,246 | 8/1965 | Fischer | 446/108 |
| 3,432,960 | 3/1969 | Bombaci . | |
| 3,701,214 | 10/1972 | Sakamoto . | |
| 3,855,752 | 12/1974 | Aylon | 52/605 |
| 3,882,630 | 5/1975 | Bianco | 446/85 |
| 4,107,894 | 8/1978 | Mullins | 52/593 |
| 4,182,072 | 1/1980 | Much . | |
| 4,519,724 | 5/1985 | Ribas | 446/115 |
| 4,740,188 | 4/1988 | Coster | 446/106 |
| 4,776,719 | 10/1988 | Kreider | 446/122 |
| 5,212,842 | 5/1993 | Glydon | 446/85 |
| 5,215,490 | 6/1993 | Szoradi | 446/115 |
| 5,251,900 | 10/1993 | Gallant | 273/157 R |
| 5,281,181 | 1/1994 | McCollum | 446/106 |
| 5,378,185 | 1/1995 | Ban | 446/120 |

FOREIGN PATENT DOCUMENTS

| | | | |
|---|---|---|---|
| 132550 | 5/1949 | Australia | 446/114 |
| 931491 | 2/1948 | France | 446/113 |
| 956627 | 2/1950 | France | 446/113 |
| 2113462 | 6/1972 | France . | |
| 207086 | 2/1909 | Germany | 446/114 |
| 2301981 | 7/1974 | Germany | 446/106 |
| 325343 | 6/1936 | Italy | 446/113 |
| WO9415688 | 7/1994 | WIPO . | |

*Primary Examiner*—Robert A. Hafer
*Assistant Examiner*—Jeffrey D. Carlson
*Attorney, Agent, or Firm*—Raymond Sun

[57] ABSTRACT

A constructional system provides a plurality of pieces that can be used to assemble an object. The object includes a connector piece having a shaft that includes opposing first and second ends, and a first deformable section including opposing first and second bars extending from the first end of the shaft. A first notch is defined by the first bar and a first shaft edge, and a second notch is defined by the second bar and a second shaft edge, with the first deformable section having a width defined by the opposing first and second bars. The object further includes a first body piece provided with an aperture having a dimension which is substantially smaller than the width of the first deformable section. The opposing first and second bars of the first deformable section of the connector piece are deformed to insert the first deformable section through the aperture to effectuate a connection of the first deformable section with the first body piece at the location of the aperture.

19 Claims, 6 Drawing Sheets

CONSTRUCTIONAL PIECES WITH DEFORMABLE JOINTS

RELATED APPLICATIONS

This application is a continuation-in-part of U.S. Ser. No. 08/632,678, filed Apr. 16, 1996, and entitled "Constructional Toy With Deformable Joints", which is incorporated by this reference as though set forth fully herein.

BACKGROUND OF THE INVENTION

1. Field of the Invention

The present invention relates to a constructional piece system, and in particular, to two or three dimensional objects that can be constructed or assembled from a plurality of pieces. Each piece includes either at least one aperture, or at least one deformable section, or at least one aperture together with at least one deformable section. The deformable sections can be deformed to insert the deformable section through an aperture in another piece, the deformable section returning to its original shape after insertion through the aperture, to form a connection between the two pieces.

2. Description of the Prior Art

Constructional toys and objects are popular among both children and adults. Such constructional objects can include three-dimensional self-standing structures and objects that are assembled by interconnecting a variety of pieces.

Examples of prior three-dimensional structures that are assembled from pieces are illustrated in U.S. Pat. Nos. 2,278,327 (Magnus et al.), 3,701,214 (Sakamoto) and 5,251,900 (Gallant). The pieces used to assemble these structures are interconnected by means of dovetail joints. However, the use of dovetail joints mean that these structures tend to be bulky and not flexible, and therefore do not allow the user to assemble a wide variety of three-dimensional structures and sometimes make them difficult to move around, especially by children.

Another example of a prior constructional object assembled from pieces is illustrated in U.S. Pat. No. 2,712,200 (Dearling), in which each piece or element 10 has a tongue 18 formed by creating notches 12 at a neck 14, and a cross-shaped aperture 20 having a longitudinal slot 22 and a shorter transverse slot 24. To join the two elements 10 and 10*a*, the tongue 18*a* of element 10*a* is first inserted through the longitudinal slot 22 until the neck 14*a* reaches the opening of transverse slot 24, after which the neck 14*a* is twisted until it is seated in transverse slot 24. Unfortunately, the cross-shaped aperture limits the angles at which the piece 10*a* can be connected, thereby limiting the variety of structures or objects that can be assembled from the pieces.

Another problem associated with certain prior constructional systems is that the connections are not sufficiently stable to permit an assembled structure to be retained in a permanent state and to be moved from and to different locations. An example is illustrated in U.S. Pat. No. 5,378,185 (Ban).

Thus, there remains a need for a plurality of interconnecting pieces that can provide stable connections for the assembled object, which have enough flexibility and variety so that they can be assembled into a wide variety of different three-dimensional objects, and which objects are lightweight and can be moved around easily.

SUMMARY OF THE DISCLOSURE

In order to accomplish the objects of the present invention, there is provided a constructional system having a plurality of pieces that can be used to assemble or construct an object. The object includes a connector piece having a shaft that includes opposing first and second ends, and a first deformable section including opposing first and second bars extending from the first end of the shaft. A first notch is defined by the first bar and a first shaft edge, and a second notch is defined by the second bar and a second shaft edge, with the first deformable section having a width defined by the opposing first and second bars. The object further includes a first body piece provided with an aperture having a dimension which is substantially smaller than the width of the first deformable section. The opposing first and second bars of the first deformable section of the connector piece are deformed to insert the first deformable section through the aperture to effectuate a connection of the first deformable section with the first body piece at the location of the aperture. The shaft is fitted in the aperture with the first and second shaft edges adjacent at least one edge of the aperture to effectuate the connection.

In a first embodiment, the connector piece further includes a second deformable section having opposing first and second bars extending from the second end of the shaft, the second deformable section also having a width defined by its opposing first and second bars. The first and second notches are further defined by the first and second bars, respectively, of the second deformable section.

The connector can be used to connect a second body piece to the first body piece. This is accomplished by deforming the bars of the first deformable section to insert the first deformable section through the apertures of the first and second body pieces to effectuate a connection of the first deformable section with the first and second body pieces at the location of the apertures, with the first and second body pieces being disposed parallel to each other. Other connectors can be connected to different apertures of the first body piece to connect the first body piece to other body pieces.

In a second embodiment, the connector piece further includes a third deformable section having first and second bars extending in opposite directions from a central portion of the shaft. The first notch is defined by the first bars of the first and third deformable sections, the second notch is defined by the second bars of the first and third deformable sections, a third notch is defined by the first bars of the second and third deformable sections, and a fourth notch is defined by the second bars of the second and third deformable sections. At least one body piece is received inside the first and second notches, and at least one body piece is received inside the third and fourth notches. To connect this connector to the first body piece, the bars of the third deformable section may be deformed to insert the third deformable section through the aperture of the first body piece.

In a third embodiment, the connector piece further includes a second shaft having first and second shaft edges and opposing first and second ends, and a second deformable section having opposing first and second bars extending from the first end of the second shaft. A first notch of the second deformable section is defined by the first bar and the first shaft edge of the second shaft, and a second notch of the second deformable section is defined by the second bar and the second shaft edge of the second shaft. The second deformable section has a width defined by its opposing first and second bars. The first and second deformable sections are disposed at approximately right angles to each other. This connector may be used to connect two body pieces by deforming the opposing bars of each deformable section and inserting each deformable section into an aperture in two separate body pieces, such that the two body pieces are disposed at approximately right angles to each other. When connected, at least one body piece is received inside the first and second notches of the first deformable section, and at least one body piece is received inside the first and second notches of the second deformable section.

In a fourth embodiment, the connector piece has four deformable sections, with each deformable section oriented approximately ninety degrees (or at right angles) from its two adjacent deformable sections and including left and right notches on opposite side edges of its shaft.

The connector pieces according to any of the above embodiments may optionally include one or more apertures.

The body pieces according to the present invention may be provided with apertures of different shapes and sizes. In one embodiment, the aperture has a circular configuration, and the width of the aperture has a dimension of about half of the width of the first deformable section.

In a fifth embodiment, the body piece further includes a slit extending from the aperture to a longitudinal side edge to define first and second deformable body portions adjacent the slit.

Thus, the constructional system according to the present invention allows the user to assemble a large variety of simple and complex two and three-dimensional objects. The constructional system of the present invention is therefore challenging and exciting, and is a good educational toy for children. The connections of the pieces and connectors are stable, and the material used is light-weight, so that the assembled objects can be kept in a permanent state if desired and moved around easily.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The constructional system of the present invention comprises a plurality of connectors and a plurality of body pieces, which are hereinafter referred to as "pieces". Each piece has at least one aperture which is adapted to receive a deformable section of a connector. Each connector can optionally include at least one aperture so that it can be connected to other connectors. Similarly, each piece can optionally include at least one deformable section so that it can be connected to other pieces. The dimension of each aperture is sized and configured to be smaller than the width of the deformable section so that the deformable section must be deformed or bent to insert it through the aperture to create the connection. The connectors and pieces can be provided in different shapes and sizes to allow for variety in construction.

The connectors and pieces of the present invention can be used to assemble a wide variety of objects and articles of use, including but not limited to planes, ships, trains, buildings, furniture, automobiles, animals, plants, belts, watches, visors, and abstract sculptures.

Each of the connectors and pieces according to the present invention is made from a material that is soft and flexible to allow it to be bent, folded or otherwise deformed, yet strong enough to allow the structures or objects created from connections of such pieces and connectors to have structural stability. Examples of such materials include but are not limited to foam, polyethylene, polyurethane and PVC (expanded foam).

Figure 1:
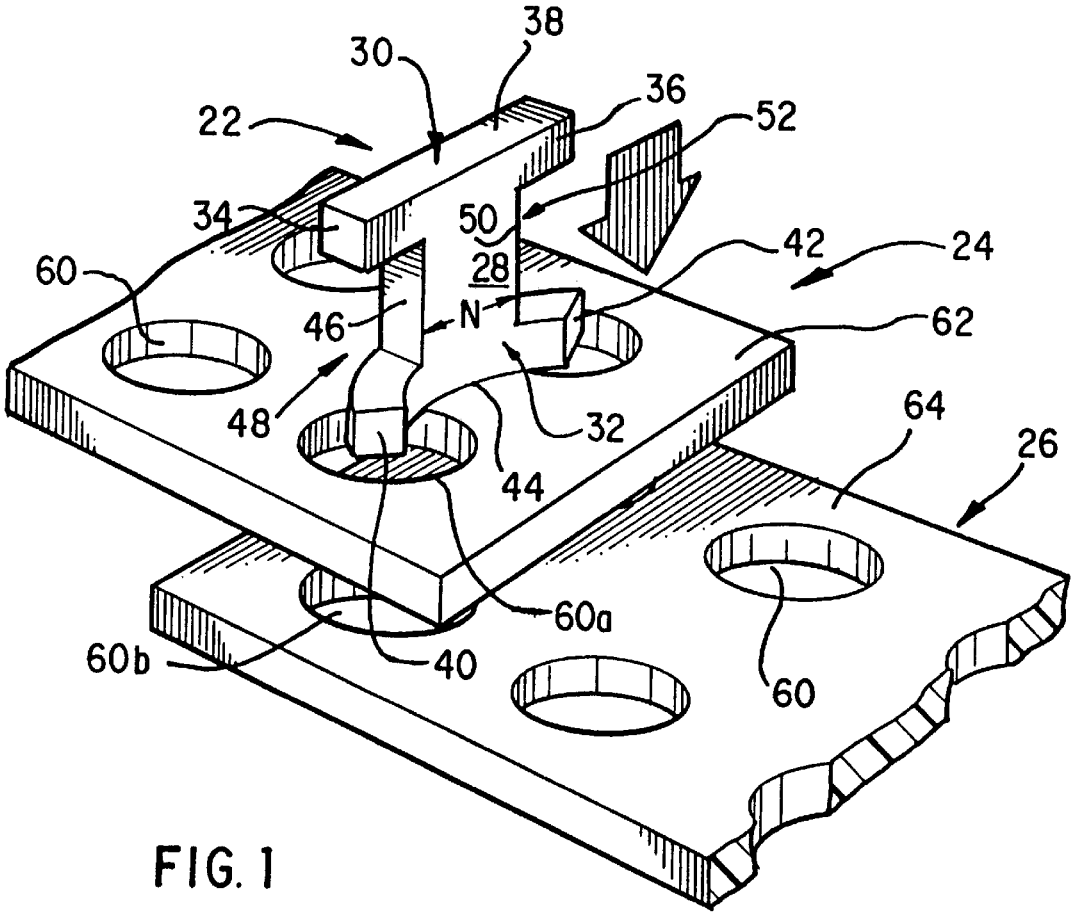
FIG. 1 illustrates a connector used to interconnect two separate pieces according to a first embodiment of the present invention.

FIG. 1 illustrates a connector 22 according to a first embodiment used to connect two separate pieces 24 and 26. The connector 22 has a strip of material forming a shaft 28, with two deformable sections 30 and 32 at opposite ends thereof. The thickness of the connector 22 is preferably consistent throughout. Deformable section 30 has bars 34 and 36 extending in opposite directions from a top edge 38 of the shaft 28, and deformable section 32 has bars 40 and 42 extending in opposite directions from a bottom edge 44 of the shaft 28. Bars 34 and 40 together with a first side edge 46 define a first notch 48, and bars 36 and 42 together with a second side edge 50 define a second notch 52 opposite to the first notch 48. The deformable sections 30 and 32 are preferably identical.

Portions of the pieces 24 and 26 are illustrated in FIG. 1. Each piece 24 and 26 is preferably a thin body of soft and flexible material 62 and 64, respectively, having a consistent thickness throughout and is provided with at least one aperture extending through the material. In this embodiment, the pieces 24 and 26 are provided with a plurality of substantially circular apertures 60 that are arranged in a pattern of rows and columns. However, it will be appreciated that different arrangements of apertures on different pieces 24 and 26 can be used without departing from the spirit and scope of the present invention. Further, the apertures 60 on different pieces can be provided in many different shapes, such as but not limited to those shapes illustrated in my co-pending U.S. Ser. No. 08/632,678, filed Apr. 16, 1996, and entitled "Constructional Toy With Deformable Joints". Similarly, the pieces 24 and 26 can be provided in different shapes and sizes.

Some non-limiting preferred dimensions for the connector 22 and the pieces 24 and 26 shall be provided to illustrate the relationship between the sizes of the deformable sections 30 and 32 and the apertures 60. The dimensions will be described relative to a basic unit "x", with x being the thickness of the connector 22 and the pieces 24 and 26. For example, the width of the deformable sections 30 and 32 is about 4x, the width N of the shaft 28 is about 2.25x, the size or opening of the notches 48 and 52 (i.e., the length of the side edges 46 and 50) is about 2x, and the diameter of the apertures 60 is about 2x. In a preferred embodiment, the basic unit x is equal to about 0.25 inches. It will be appreciated that the above dimensions can be changed by changing the dimension of the basic unit, and any change in one of these dimensions would necessitate a corresponding change in the other dimensions.

The connector 22 is used to connect the pieces 24 and 26 through apertures 60*a* and 60*b* according to the following method. Since the apertures 60 according to this embodiment are about half the dimension of the width of the corresponding deformable sections 30 and 32, the deformable sections 30 and 32 cannot be inserted through the apertures 60 without deforming the deformable sections 30 and 32. Therefore, referring to FIG. 1, the opposing bars 40 and 42 of the deformable section 32 are bent or folded towards each other to reduce the overall profile of the deformable section 32 so that the entire deformable section 32 can be inserted or passed through the apertures 60*a* and 60*b* of the pieces 24 and 26, respectively. The desired apertures 60*a* and 60*b* must first be selected. Thereafter, the apertures 60*a* and 60*b* can aligned prior to the passage of the deformable section 32 therethrough. Alternatively, the user can first insert the deformable section 32 through the first aperture 60*a* and then insert the deformable section 32 through the second aperture 60*b* to complete the connection.

Alternatively, the deformable section 30 can be deformed and inserted through apertures 60*b* and 60*a,* in this order, to achieve the same connection.

Figure 2:
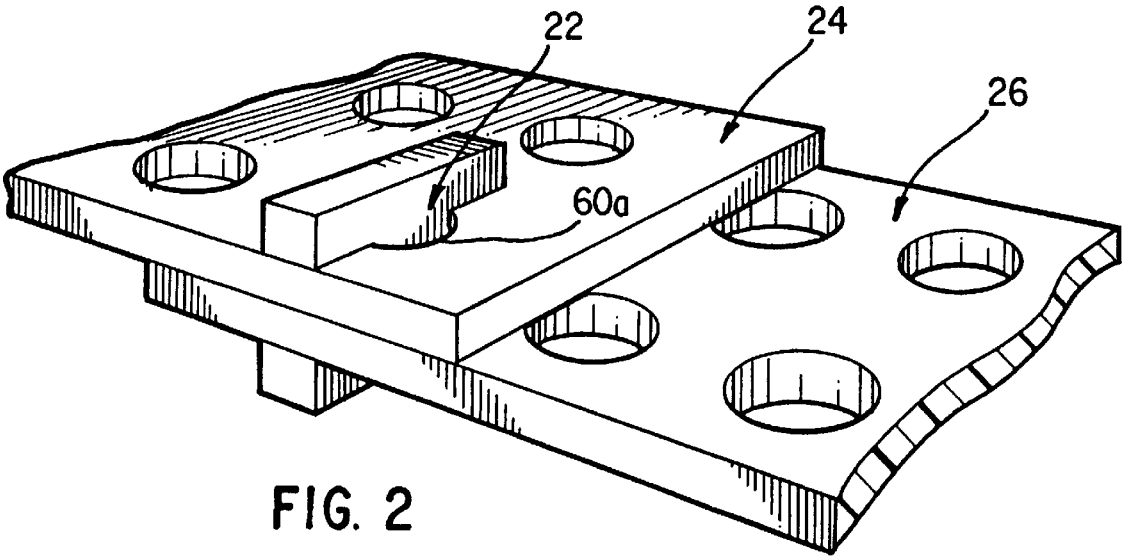
FIG. 2 illustrates the connection of two separate pieces in a parallel manner by the connector of FIG. 1.

After the deformable section 32 and its bars 40 and 42 have passed through the apertures 60*a* and 60*b,* the pieces 24 and 26 will be received inside the notches 48 and 52. When secured in this manner, the side edges 46 and 50 of notches 48 and 52, respectively, are positioned adjacent to or in contact with the circumferential edges of the apertures 60*a* and 60*b,* and the bodies of the pieces 24 and 26 are held by the two sets of bars 34, 40 and 36, 42 that define the notches 48 and 52, respectively. The resulting connection is shown in FIG. 2. Pieces 24 and 26 are positioned parallel to each other. By "parallel", it is meant that the major plane of the body of piece 24 is parallel to the major plane of the body of piece 26. Since the size of the notches 48 and 52 has a dimension of 2x, the bodies of the two pieces 24 and 26, each having a thickness of x, will be snugly fitted inside the notches 48 and 52, and securely held by the connector 22.

The relative position of pieces 24 and 26 can be manually adjusted. For example, piece 24 may be rotated with respect to piece 26 to change the orientation of the pieces 24 and 26.

To disengage the connection, the opposing bars, for example 40 and 42, of deformable section 32 are folded or bent again, and passed back through the apertures 60*a* and 60*b* to disengage the two pieces 24 and 26. Although the pieces according to the present invention may be readily disengaged so that the object can be completely disassembled, the structural stability of the resulting object also allows the user to keep the object permanently assembled without any disassembly.

It will be appreciated that the size of the notches 48 and 52 can be adjusted to accommodate a different number of pieces in the desired connection. For example, if the connector 22 is to be used to connect three pieces, then the notches 48 and 52 should have a size of about 3x, and so on.

In addition, other connectors can be connected to different apertures of piece 24 or 26 to connect the piece 24 or 26 to other body pieces. Thus, as many connectors may be applied to a piece as necessary to create the desired object.

Thus, by allowing the sizes and shapes of the pieces 24 and 26 and the connector 22 to be varied, a constructional system can be provided which allows the user to construct an unlimited variety of objects and articles.

Figure 3:
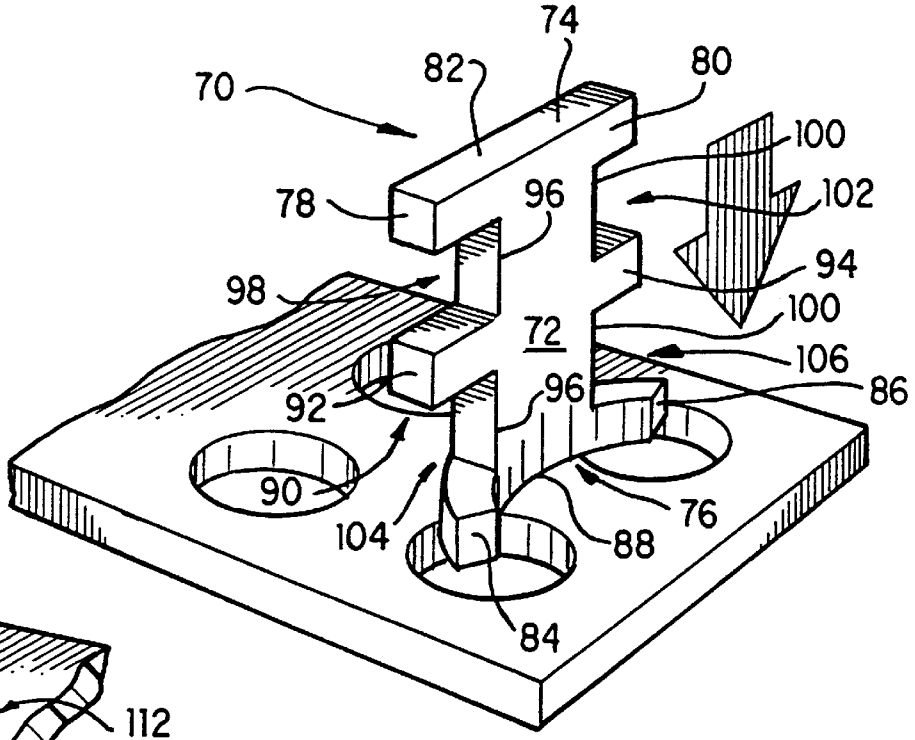
FIG. 3 illustrates a connector according to a second embodiment of the present invention.

Another connector 70 according to a second embodiment of the present invention is illustrated in FIG. 3. The connector 70 is similar to the connector 22 except that it has two additional notches. The connector 70 has a strip of material forming a shaft 72, with first and second deformable sections 74 and 76 at opposite ends thereof. The thickness of the connector 70 is preferably consistent throughout. First deformable section 74 has bars 78 and 80 extending in opposite directions from a top edge 82 of the shaft 72, and second deformable section 76 has bars 84 and 86 extending in opposite directions from a bottom edge 88 of the shaft 72. A third deformable section 90 having opposing bars 92 and 94 extend between the first and second deformable sections 74 and 76. Bars 78 and 92 together with a first side edge 96 define a first notch 98, bars 80 and 94 together with a second side edge 100 define a second notch 102 opposite to the first notch 98, bars 84 and 92 together with the first side edge 96 define a third notch 104, and bars 86 and 94 together with the second side edge 100 define a fourth notch 106 opposite to the third notch 104. The deformable sections 74 and 76 are preferably identical.

Figure 4:
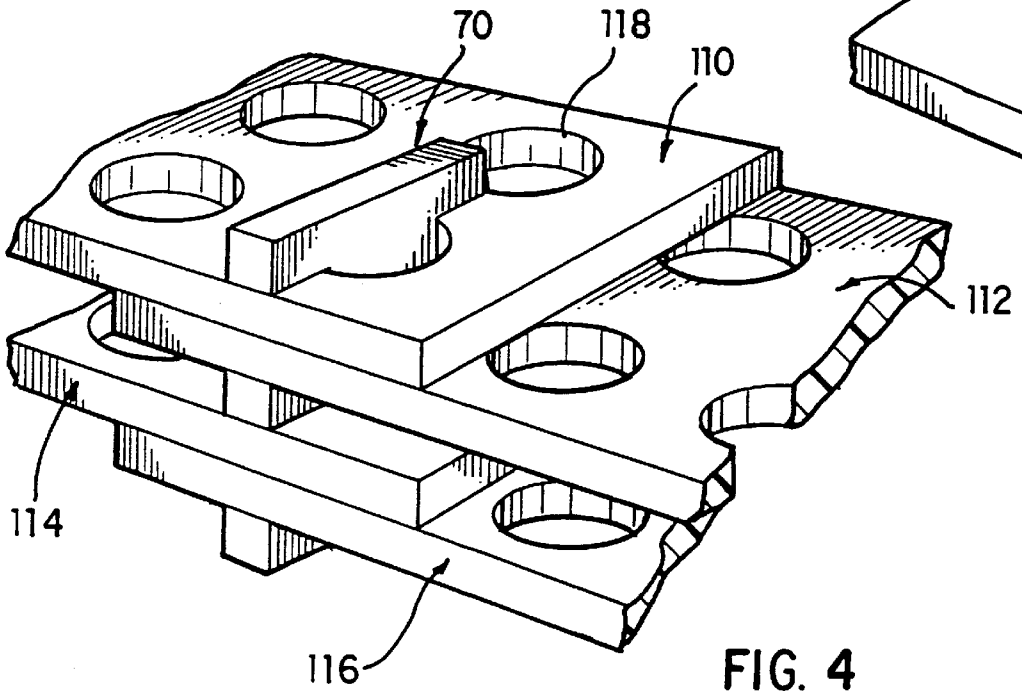
FIG. 4 illustrates the connection of four separate pieces in a parallel manner by the connector of FIG. 3.

Referring to FIG. 4, first and second notches 98 and 102 are adapted to receive two pieces 110 and 112, and third and fourth notches 104 and 106 are adapted to receive another two pieces 114 and 116. Pieces 110, 112, 114 and 116 may have the same features as pieces 24 and 26, and for example, are provided with substantially circular apertures 118. The connections may be achieved according to the same method described above in connection with the first embodiment of FIGS. 1 and 2. Specifically, the first deformable section 74 is first deformed and passed through two selected apertures in pieces 110 and 112, and the second deformable section 76 is then deformed and passed through two selected apertures in pieces 114 and 116. The four pieces 110, 112, 114 and 116 are positioned parallel to each other.

Alternatively, first deformable section 74 or second deformable section 76 can be deformed and passed through selected apertures in all four pieces 110, 112, 114 and 116, with third deformable section 90 deformed and passed through selected apertures in two of the pieces 110 and 112, or 114 and 116.

Similar to notches 48 and 52 in connector 22, the size of the notches 98, 102, 104 and 106 is about 2x. However, the sizes of the notches 98, 102, 104 and 106 can likewise be varied so that three or more pieces can be received within each opposing pair of notches 98 and 102, or 104 and 106.

Figure 5:
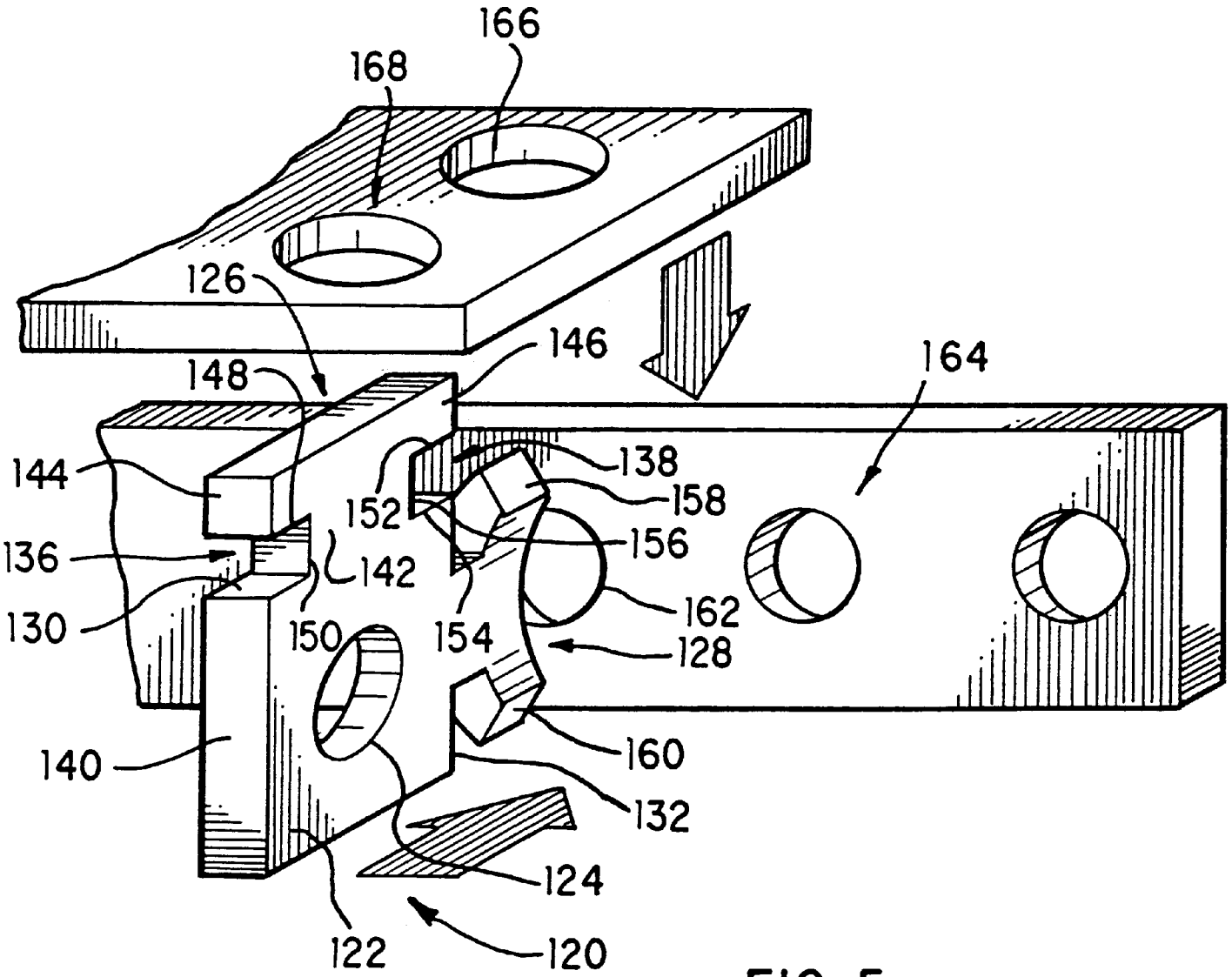
FIG. 5 illustrates a connector used to interconnect two separate pieces according to a third embodiment of the present invention.

Another connector 120 according to a third embodiment of the present invention is illustrated in FIG. 5. Connector 120 has a substantially square body 122 with a substantially circular aperture 124 provided therein. First and second deformable sections 126 and 128 are provided at adjacent side edges 130 and 132, respectively, of body 122 which are at right angles to each other. The thickness of body 122 is preferably consistent throughout.

Deformable section 126 has opposing notches 136 and 138 that are cut from opposing longitudinal side edges 140 and 132, respectively, of body 122 to define a shaft 142 and opposing bars 144 and 146, respectively. Notch 136 is itself defined by substantially straight side edges 148 and 130 and a substantially straight shaft edge 150. Similarly, notch 138 is itself defined by substantially straight side edges 152 and 154 and a substantially straight shaft edge 156. The deformable section 128 is substantially identical to deformable section 126 except that it extends from side edge 132. Each notch of the deformable sections 126 and 128 preferably has a width of about x.

Figure 6:
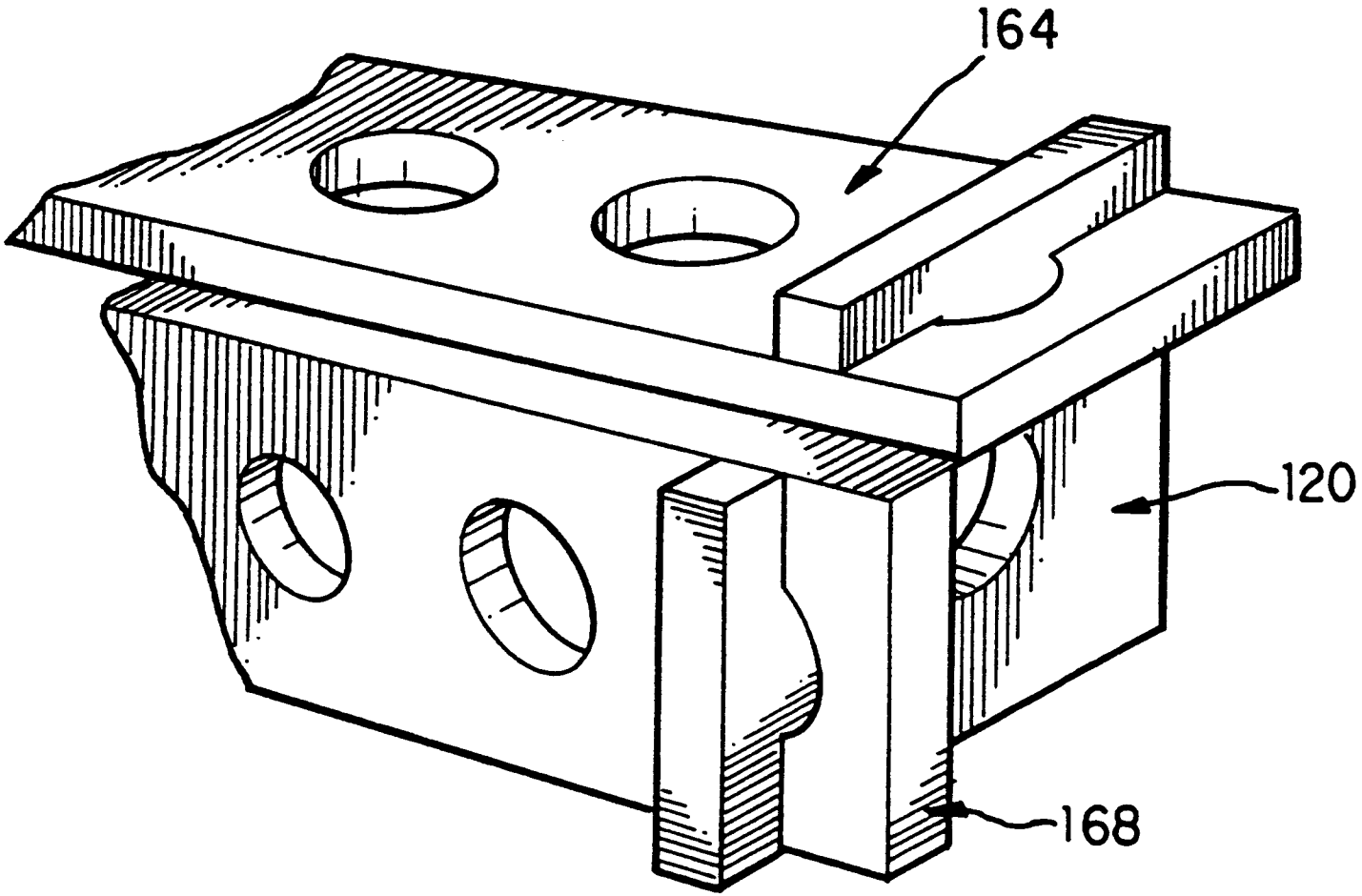
FIG. 6 illustrates the connection of two separate pieces in a perpendicular manner by the connector of FIG. 5.

The connector 120 is used to facilitate the connection of two or more pieces at right angles (i.e., approximately ninety degrees) to each other. Referring to FIG. 5, the opposing bars 158 and 160 of deformable section 128 may be deformed and passed through an aperture 162 in a piece 164, and the opposing bars 144 and 146 of deformable section 126 may be deformed and passed through an aperture 166 in another piece 168. Since deformable sections 126 and 128 are at right angles to each other, pieces 164 and 168 will be connected at right angles to each other. FIG. 6 illustrates the right-angled connection of portions of the pieces 164 and 168 by connector 120. The opposing notches 136 and 138 of the first deformable section 126 retain the body of the piece 168, while the opposing notches of the second deformable section 128 retain the body of piece 164. The connector 120 therefore allows for the assembly of corner joints for the desired object.

The aperture 124 in connector 120 is adapted to receive a deformable section of another connector, thereby enabling the connector 120 to be connected to other pieces. In this regard, the connector 120 is not necessarily a connector and may actually also be a body piece that includes one or more deformable sections. As such, any of the body pieces according to the present invention may be provided with apertures only, or together with deformable sections to facilitate direct connection to other pieces. Conversely, a connector may be provided with one or more deformable sections, with or without any apertures.

Figure 7:
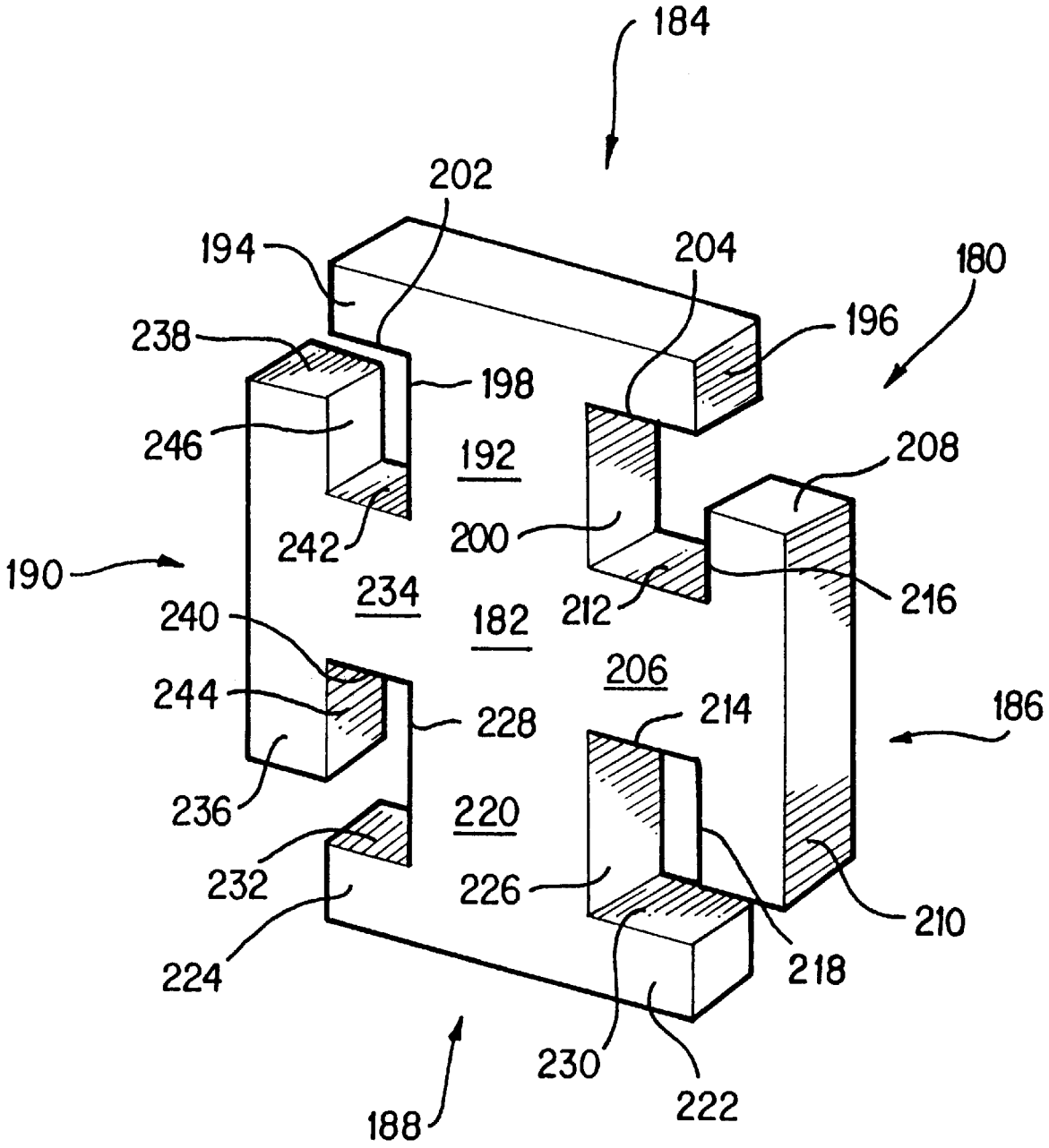
FIG. 7 illustrates an alternative connector according to a fourth embodiment that can be used to connect separate pieces in a perpendicular manner.

Another connector 180 according to a fourth embodiment of the present invention is illustrated in FIG. 7. Connector 180 has a substantially cross-shaped body 182 with four deformable sections 184, 186, 188 and 190, each extending at right angles or at ninety degrees to the two adjacent deformable sections. The thickness of body 182 is preferably consistent throughout.

First deformable section 184 has a shaft portion 192 with opposing bars 194 and 196 extending therefrom. Shaft 192 has side edges 198 and 200 on either side thereof that are connected to inner edges 202 and 204, respectively, of bars 194 and 196, respectively. Similarly, second deformable section 186 has a shaft portion 206 with opposing bars 208 and 210 extending therefrom. Shaft 206 has side edges 212 and 214 on either side thereof that are connected to inner edges 216 and 218, respectively, of bars 208 and 210, respectively. Third deformable section 188 has a shaft portion 220 with opposing bars 222 and 224 extending therefrom. Shaft 220 has side edges 226 and 228 on either side thereof that are connected to inner edges 230 and 232, respectively, of bars 222 and 224, respectively. Fourth deformable section 190 has a shaft portion 234 with opposing bars 236 and 238 extending therefrom. Shaft 234 has side edges 240 and 242 on either side thereof that are connected to inner edges 244 and 246, respectively, of bars 236 and 238, respectively.

Each of the four shafts 192, 206, 220 and 234 extends in a direction that is at about ninety degrees from the two adjacent shafts to define the cross-shaped connector 180. Left and right notches are defined along the side edges of the shafts for each deformable section. For example, a left notch for deformable section 184 is defined by the inner edge 202 of bar 194, edge 198 of shaft 192 and edge 242 of adjacent shaft 234. Similarly, a right notch for deformable section 184 is defined by the inner edge 204 of bar 196, edge 200 of shaft 192 and edge 212 of the other adjacent shaft 206. As an additional example, a left notch for deformable section 186 is defined by the inner edge 216 of bar 208, edge 212 of shaft 206 and edge 200 of adjacent shaft 192. Similarly, a right notch for deformable section 186 is defined by the inner edge 218 of bar 210, edge 214 of shaft 206 and edge 226 of the other adjacent shaft 220. The left and right notches for deformable sections 188 and 190 are defined in similar manners.

Each pair of left and right notches of each of the deformable sections 184, 186, 188 and 190 is adapted to receive and secure one or more pieces. As such, the size of the notches, which can also be defined by the dimension of side edges 198, 200, 212, 214, 226, 228, 240 and 242, can have a width of about x (to receive one piece), 2x (to receive two pieces), 3x (to receive three pieces), and so on. Although the four deformable sections 184, 186, 188 and 190 are illustrated as being identical, the deformable sections can be provided in different sizes and shapes by varying the length or dimension of the shaft. As a non-limiting example, shaft 192 can have a length of x so that its left and right notches are adapted to receive one piece, while shaft 220 can have a length of 2x so that its left and right notches are adapted to receive two pieces. In addition, it is possible to provide the deformable sections 184, 186, 188 and 190 at an orientation in which they are oriented to each other at other than right angles.

The connector 180 is used in the same manner as the other connectors described above. The bars of the specified deformable section are bent or folded towards each other to reduce the overall profile of the deformable section so that the entire deformable section can be inserted or passed through the desired aperture(s) in the piece(s) to be connected, with the piece(s) fitted in the left and right notches of the deformable section. In addition, one or more apertures can be provided in the body 182 to allow other connectors to be connected to it.

Figure 8:
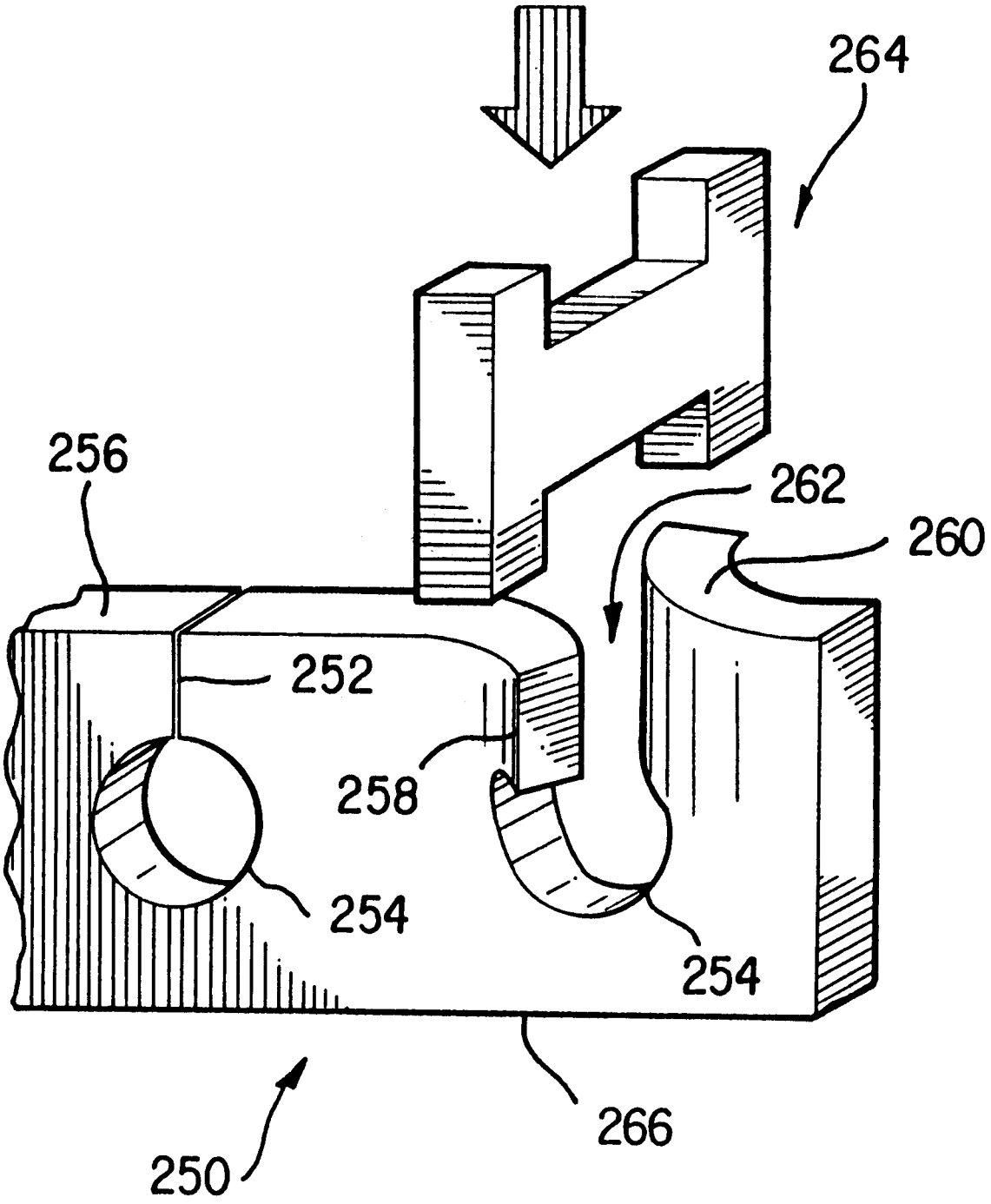
FIG. 8 illustrates a piece according to a fifth embodiment of the present invention and adapted to receive a connector.

The pieces 110, 112, 114, 116, 164, 168 may all have the same general features as those described above for pieces 24 and 26. However, FIG. 8 illustrates a fifth embodiment according to the present invention, which includes a modification to the pieces described above. The piece 250 is essentially the same as piece 24 of FIG. 1, except that a pre-cut slit 252 is provided on one side of an aperture 254 extending from the aperture 254 to a side edge 256 of the piece 250. The slit 252 divides the wall of the piece 250 into two separate foldable or bendable flaps 258 and 260. Referring to FIG. 8, each flap 258 and 260 may be folded or bent to one side to create an opening 262 so that a connector 264 can be passed through the opening 262 and fitted inside the aperture 254. The flaps 258 and 260 are then allowed to return to their original position to complete the connection.

All apertures and deformable sections according to the present invention are preferably provided in corresponding configurations and sizes so that they can be used universally to interconnect other connectors and pieces. However, it is possible to provide apertures and deformable sections in a few different predetermined configurations and sizes so that certain deformable sections will be adapted for use in apertures of the corresponding size and configuration. For example, each piece may be provided with two or more sets of apertures, one set having smaller apertures adapted for connection with smaller deformable sections, a second set having larger apertures adapted for connection with larger deformable sections, and so on.

In addition, any combination of the pieces described in the present invention may be provided in the constructional system of the present invention, and any combination of configurations for the apertures and deformable sections can be provided for any piece within the system. For example, it is possible to provide different pieces with differently configured apertures, including providing a piece in which each of its apertures has a different configuration, and with each such aperture having a different size for use with deformable sections of different sizes.

The connectors and pieces according to the present invention can be decorated with designs and colors to provide aesthetically pleasing pieces. For example, the connectors and pieces can be provided in certain pre-determined colors. The surfaces of the connectors and pieces may also be laminated with printed labels or may be directly printed with graphics, decals or other decorative images.

Thus, the pieces and connectors according to the present invention can be packaged in a constructional system which allows the user to assemble a large variety of simple and/or complex two and three-dimensional objects. Adults and children will find the unlimited possibilities offered by the constructional system of the present invention to be challenging and exciting, and to be a good educational toy for children. The connections of the various pieces and connectors are stable, and the material used is light-weight, so that the assembled objects can be kept in a permanent state and moved around easily.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An object assembled by interconnecting a plurality of pieces, the plurality of pieces including a first piece and a second piece, the object comprising:

a first piece having a shaft having a first end, the first piece further including a first deformable section including opposing first and second bars extending from the first end of the shaft to define first and second notches, the opposing first and second bars also defining the width of the first deformable section; and a second piece including an aperture having a width and a widest dimension that is no greater than about half the width of the first deformable section of the first piece;

wherein the opposing first and second bars of the first deformable section of the first piece are deformed to insert the first deformable section through the aperture of the second piece to effectuate a connection of the first deformable section with the second piece at the location of the aperture.

2. The object of claim 1, wherein the first piece further includes a second end opposite the first end, and a second deformable section having opposing first and second bars extending from the second end of the shaft, the second deformable section having a width defined by its opposing first and second bars.

3. The object of claim 2, wherein first and second notches are further defined by the first and second bars, respectively, of the second deformable section.

4. The object of claim 2, wherein the shaft has first and second shaft edges, and the shaft is fitted in the aperture with the first and second shaft edges adjacent at least one edge of the aperture to effectuate the connection.

5. The object of claim 2, further comprising a third piece, the third piece including an aperture having a width and a widest dimension that is no greater than about half the width of the first deformable section of the first piece; and wherein the bars of the first deformable section are deformed to insert the first deformable section through the apertures of the second and third pieces to effectuate a connection of the first deformable section with the second and third pieces at the location of the apertures, the second and third pieces being disposed generally parallel to each other.

6. The object of claim 1, wherein the aperture has a circular configuration with a circumferential edge.

7. The object of claim 1, wherein the second piece further includes a longitudinal side edge, and a slit extending from the aperture to the longitudinal side edge defining first and second deformable body portions adjacent the slit.

8. The object of claim 2, wherein the first piece further includes a third deformable section having first and second bars extending in opposite directions from a central portion of the shaft, with the first notch defined by the first bars of the first and third deformable sections, the second notch defined by the second bars of the first and third deformable sections, a third notch defined by the first bars of the second and third deformable sections, and a fourth notch defined by the second bars of the second and third deformable sections.

9. The object of claim 8, wherein at least one piece is received inside the first and second notches, and at least one piece is received inside the third and fourth notches.

10. The object of claim 8, wherein the bars of the third deformable section are deformed to insert the third deformable section through the aperture of the second piece to effectuate a connection of the third deformable section with the second piece at the location of the aperture.

11. The object of claim 1, wherein the first piece further includes a second shaft having a first end, and a second deformable section including opposing first and second bars extending from the first end of the second shaft, a first notch defined by the first bar and the second shaft, and a second notch defined by the second bar and the second shaft, the second deformable section having a width defined by its opposing first and second bars; and wherein the first and second deformable sections are disposed at right angles to each other.

12. The object of claim 11, further including a third piece having a body and a second aperture having a widest dimension that is no greater than about half the width of the first deformable section of the first piece;

wherein the opposing first and second bars of the first deformable section of the first piece are deformed to insert the first deformable section through the aperture of the second piece to effectuate a connection of the first deformable section with the second piece at the location of the aperture of the second piece, and the opposing first and second bars of the second deformable section of the first piece are deformed to insert the second deformable section through the second aperture to effectuate a connection of the second deformable section with the third piece at the location of the second aperture, such that the second and third pieces are disposed at right angles to each other.

13. The object of claim 12, wherein at least one piece is received inside the first and second notches of the first deformable section, and at least one piece is received inside the first and second notches of the second deformable section.

14. The object of claim 11, wherein the first piece further includes an aperture.

15. The object of claim 1, wherein the first piece has four deformable sections, each deformable section oriented approximately ninety degrees from its two adjacent deformable sections and having left and right notches on opposite side edges of its shaft.

16. The object of claim 1, wherein the second piece further includes a second aperture, and wherein the object further includes:

a third piece having a shaft having a first end, the third piece further including a first deformable section including opposing first and second bars extending from the first end of the shaft to define first and second notches, the first deformable section having a width defined by the opposing first and second bars; and wherein the opposing first and second bars of the first deformable section of the third piece are deformed to insert the first deformable section through the second aperture of the second piece to effectuate a connection of the first deformable section of the third piece with the second piece at the location of the second aperture.

17. A method of assembling a plurality of pieces to create an object, comprising:

a. providing a first piece having a shaft having a first end, the first piece further including a first deformable section including opposing first and second bars extending from the first end of the shaft to define first and second notches, the first deformable section having a width defined by the opposing first and second bars;

b. providing a second piece including an aperture having a width and a widest dimension that is no greater than about half the width of the first deformable section of the first piece; and c. bending the opposing bars of the first deformable section to insert the first deformable section through the aperture of the body piece to effectuate a connection of the first deformable section with the second piece at the location of the aperture.

18. The method of claim 17, further comprising:

d. providing a third piece including an aperture having a width with a widest dimension that is no greater than about half the width of the first deformable section of the first piece; and e. bending the opposing bars of the first deformable section to insert the first deformable section through the aperture of the third piece to effectuate a connection of the first deformable section with the third piece at the location of the aperture.

19. The method of claim 17, wherein the second piece further includes a second aperture, the method further comprising:

d. providing a third piece having a shaft having a first end, the third piece further including a first deformable section including opposing first and second bars extending from the first end of the shaft to define first and second notches, the first deformable section having a width defined by the opposing first and second bars; and e. bending the opposing bars of the first deformable section of the third piece to insert the first deformable section of the third piece through the second aperture of the second piece.

* * * * *